United States Patent [19]

Beyer et al.

[11] 4,019,928

[45] Apr. 26, 1977

[54] PROCESS FOR NITRIDING IRON AND STEEL IN SALT BATHS REGENERATED WITH TRIAZINE POLYMERS

[75] Inventors: Hermann Beyer; Peter Biberbach; Christian Scondo, all of Hanau, Germany

[73] Assignee: Duetsche Gold- und Silber-Scheideanstalt vormals Roessler, Frankfurt, Germany

[22] Filed: June 30, 1976

[21] Appl. No.: 701,361

Related U.S. Application Data

[63] Continuation-in-part of Ser. No. 608,240, Aug. 27, 1975, abandoned, which is a continuation-in-part of Ser. No. 448,065, March 4, 1974, abandoned.

[30] Foreign Application Priority Data

Mar. 5, 1973 Germany ..... 2310815
Aug. 29, 1974 Germany ..... 2441310

[52] U.S. Cl. ..... 148/15.5; 148/20; 148/27

[51] Int. Cl.[2] ..... C21D 1/48

[58] Field of Search ..... 148/15.5, 16.6, 18, 148/20, 20.3, 27, 30

[56] References Cited

UNITED STATES PATENTS

| | | | |
|---|---|---|---|
| 2,095,188 | 10/1937 | Hanusch | 148/30 |
| 2,231,010 | 2/1941 | Holt | 148/15 |
| 2,541,085 | 2/1951 | Morral | 148/30 |
| 2,562,065 | 7/1951 | Sawyer et al. | 148/27 |
| 2,568,860 | 9/1951 | Leininger et al. | 148/15.5 |
| 2,711,981 | 6/1955 | Waterfall et al. | 148/15.5 |
| 2,927,875 | 3/1960 | Muller | 148/15.5 |
| 3,022,204 | 2/1962 | Muller et al. | 148/15.5 |
| 3,303,063 | 2/1967 | Pietryka | 148/15.5 |
| 3,793,208 | 2/1974 | Foreman | 148/15.5 |
| 3,912,547 | 10/1975 | Gaucher et al. | 148/15.5 |

OTHER PUBLICATIONS

Karrer, P.; Organic Chemistry, New York 1938, pp. 207, 212 and 246.

*Primary Examiner*—Walter R. Satterfield
*Attorney, Agent, or Firm*—Cushman, Darby & Cushman

[57] ABSTRACT

Iron and steel are nitrided in a salt bath in a process favorable to the environment. The salt bath consists essentially of potassium cyanate, sodium cyanate, potassium carbonate, and sodium carbonate. Preferably, air flows through the bath. The bath preferably contains 25–57 weight % of cyanate calculated as cyanate ion, 0 to 30% alkali metal chloride and the balance carbonate and alkali metal ions. Preferably cyanide is omitted, but it can be present in an amount up to 5%. Without removing the waste salt, the bath is regenerated by adding melon, melam, or melem.

34 Claims, No Drawings

PROCESS FOR NITRIDING IRON AND STEEL IN SALT BATHS REGENERATED WITH TRIAZINE POLYMERS

This application is a continuation-in-part of application Ser. No. 608,240, filed Aug. 27, 1975 and now abandoned which in turn is a continuation-in-part of application Ser. No. 448,065, filed Mar. 4, 1974 and now abandoned. The entire disclosures of the parent cases are hereby incorporated by reference and relied upon.

The invention is directed to an environmentally favorable process for the nitriding of iron and steel in salt baths which are low in cyanide or cyanide free and consist essentially of potassium cyanate, sodium cyanate, potassium carbonate and sodium carbonate.

In the salt bath nitriding of iron and steel there have been used molten bath mixture of alkali cyanides, alkali cyanates and alkali carbonates which are present as a thin liquid melt at an operating temperature of about 570° C. Generally there are used salt melts which contain between 20 and 40% cyanate, calculated as KCNO and 30 to 60% cyanide calculated as NaCN, while the rest consists of alkali carbonate (German Pat. No. 1,149,035). The workpiece is exposed to the action of the melt for several hours, whereby preferably, an airstream is led through the melt. Thereby there are formed layers which cause especially an increase of the wear resistance and the alternating bending resistance due to a diffusion of the nitrogen into the surface of the workpiece. Thereby the bath is depleted of cyanide and cyanate and is enriched by carbonate which is ineffective for the nitriding. In order to maintain their effectiveness, these baths must be regularly regenerated by additions of pure alkali cyanide whereby each time to eliminate carbonate and reduce the volume there must be discharged a not inconsiderable part of the salt melt. These so-called waste salts are always cyanide-containing and, therefore, highly toxic.

Apart therefrom that the association with the highly toxic cyanide requires special precautions in the addition and operation of the bath, the detoxification of the waste salts or their removal with subsequent safe deposition requires a very substantial expense. Also the waste water which results from the quenching and rinsing of the treated parts is highly toxic because of the cyanide residue still adhering to these parts and must therefore be detoxified before being led into the sewer system.

There have already been attempts to nitride iron and steel with average and high carbon contents using cyanide free salt melts (Japanese application No. 47-27089), whereby, however, the melt must be maintained oxygen-free and flushed with nitrogen in order to repress an excessive carbonate formation in the salt bath, which increases the liquidous temperature of the salt melt considerably and reduces the nitriding action. Besides this expensive nitrogen flushing this known nitriding bath has the further disadvantages that there can only be nitrided workpieces with relatively high carbon contents and in the regeneration, furthermore, waste salts accumulate which, to be sure, are substantially cyanide free, but contain large amounts of cyanate which, likewise, must be removed.

It was, therefore, the problem of the present invention to find an environmentally favorable process for nitriding iron and steel, even those with small carbon content, in salt baths, which baths form good nitriding layers, which baths are regenerable without accumulation of waste salts, are highly fluid, in order to keep small the entrained loss due to salt adhering to the surface of the workpiece, which most preferably are as highly free of cyanide as possible and in any event are low in cyanide, specifically containing not over 5% cyanide, more preferably containing not over 3% cyanide and most preferably are free of cyanide, to avoid the formation of toxic waste water.

This problem was solved by the invention by using as salt melts for the nitriding those which consist essentially of potassium cyanate, sodium cyanate, potassium carbonate and sodium carbonate and flowing air through such melts and which preferably contain 25–57 weight % cyanate, calculated as cyanate ion, 0 to 30% alkali metal chloride, balance carbonate and alkali metal ions and by regeneration by addition of melon, melem or melan without skimming off waste salts. Preferably, there is employed melon. There can be present 0 to 5% cyanide calculated as cyanide ions as indicated above. However, cyanide is not an essential part of the composition and most preferably is not present so that the nitriding can be carried out in a cyanide free system. Since, furthermore, there are only formed non-toxic cyanates in the salt melt, the nitriding again is carried out in a cyanide free system. Again, this has the result that in the rinsing of the completely treated workpieces removed from the bath, only non-toxic waste water is formed since the salt residue adhering to the workpieces no longer contains cyanide.

Especially recommended are salt melts having 33–42 weight % cyanate calculated as cyanate ion.

It has surprisingly turned out that there can be nitrided with good success workpieces of iron and steel with all carbon contents occurring in practice in salt melts low in cyanide or more preferably free from cyanide if these salt melts consist essentially of potassium cyanate, sodium cyanate, potassium carbonate and sodium carbonate and, most preferably, contain 25–57% cyanate calculated as the cyanate ion. Optionally, there can be present 0 to 30% of alkali metal chlorides.

There are very suited for the nitriding process of the invention salt baths which contain a high proportion of potassium salts compared to sodium salts, whereby the advantageous working range for the sodium-potassium atomic ratio is from 0 to 1.5:1. However, especially preferred are baths with a sodium-potassium atomic ratio of 0 to 0.5:1.

By the use of potassium rich salt metls, the melting point of these salt baths is reduced so that at the working temperature of about 570° C. thinly liquid melts are formed and the loss of salt carried out by the removal of the treated workpiece thereby is held low. Besides such baths can also overcome high carbonate contents which are formed from the cyanates in operation of the bath and usually increase the melting point.

While a temperature of about 570° C. is preferred for the nitriding, there can also be used other conventional nitriding temperatures, e.g., 500° to 650° C., usually not over 600° C.

The special advantage of those baths also is that they can be regenerated by the addition of melon, melam or melem without accumulating waste salts. Melon is preferred.

Melon, melam and melem under normal environmental conditions are temperature resistant and give off no toxic or dangerous constituents. They can be introduced into salt melts having a temperature of 500° to 950° C. without danger to the personnel or the environment. Melon is a polymerization product of melamine, which, for example, can be obtained by heating melamine to temperatures above 350+C, preferably at 500° C. Melon is completely stable in air at temperatures up to above 700° C. It reacts with the salt mixtures used for the nitriding at about 570° C. in quiet reaction with development of steam. It permits such salt mixtures to be replenished in a completely safe manner, as do melam and melem. This reaction is different from the reaction shown in Pietryka U.S. Pat. No. 3,303,063 in which urea reacts with ammonia to form cyanic acid which can then react with sodium carbonate to form sodium cyanate. Melam, melon and melem not only have the extremely stable triazine ring, but do not contain an oxygen atom such as that which is contained in urea and takes part in the reaction shown in Pietryka. Karrer, Organic Chemistry, New York (1938), page 212 discloses melamine. On page 246 it shows that cyanogen reacts with potassium hydroxide to form potassium cyanide and potassium cyanate. Melam, melon and melem do not form cyanogen at nitriding temperatures and cyanide is not formed in the bath regenerating process of the invention.

The amount of melon, melam or melem to be added can be determined by analyzing the cyanate loss. A decrease of 1 weight % of cyanate can be replenished by 0.5 to 1.5 weight % of polymer.

Melam, melem and melon are all well-known polymers of melamine formed by partial desamidation, see Widmer U.S. Pat. No. 2,197,357, page 1, and Kirk-Othmer Encyclopedia of Chemical Technology, 2nd edition, volume 6, page 571.

During the operation of the nitriding baths of the invention, there takes place through the oxygen of the air and the delivery of the nitrogen to the workpiece, a reaction of $CN^-$ and $CNO^-$ to $CO_3^=$ which is ineffective for the nitriding. By the addition of the above-mentioned melon, melam and melem regenerating agents, excess carbonate is changed into cyanate without increasing the volume and without increasing the amount of waste salt (which is tied thereto).

To increase the fatigue strength, the part must be quickly quenched after the treatment in the nitriding salt bath. It was not possible with known nitriding salt baths to quench the part in nitrite-nitrate salt baths because the adhering cyanide containing salt residues react explosively with the nitrite-nitrate melt.

With the low cyanide and cyanide free baths of the invention it is possible to have a safe quenching in nitrite-nitrate melts. Cyanide and cyanate are oxidized in uiet reaction to carbonate and nitrogen so that neither cyanide nor cyanate residues reach the waste water.

Also in quenching from the salt bath of the invention into water there is formed non-toxic cyanide free waste water. Any small amounts of cyanide in the nitriding salt bath which in the quenching go into the water, can be destroyed directly in the quench water by the addition of sodium hypochlorite. A separate detoxification treatment of the heat treatment room waste water can be eliminated which makes it very substantially easier to carry out the working up.

The nitriding action of the salt baths used in the process of the invention increase with increasing cyanate content. The carbonate-cyanate ratio therefore should advantageously be between 0 and 1:1. Completely carbonate free nitriding baths, to be sure, cannot operate permanently since carbonate is formed by reaction between cyanate and air oxygen.

The addition of cyanide can be completely eliminated but there always forms in the bath during the nitriding treatment a small amount of cyanide whereby the cyanide content, however, remains below 4 weight %.

There can also be employed in the process of the invention salt melts containing up to 30 weight % of alkali chloride, e.g., potassium chloride and/or sodium chloride.

Unless otherwise indicated, all parts and percentages are by weight.

The process of the invention will be futher explained in the following examples.

EXAMPLE 1

There were melted in a cylindrical titanium crucible (diameter 35 cm., height 70 cm.) 75 kg KCNO, 22 kg. $Na_2CO_3$ and 3 kg. of $K_2CO_3$ and the melt heated to 570° C. whereby a thin liquid melt was obtained and 200 liters of air per hour were led through the melt.

Plate-shaped samples of CK 15 steel were treated for 2 hours in this bath and then quenched in salt water. This quench water subsequently contained no detectable amounts of cyanide.

Testing the fatigue rotating strength on a Schenk-Rapid fatigue testing machine, there resulted an increase from $\delta_{BW}$= 12 kp/mm² before the treatment to $\delta_{BW}$ = 42 kp/mm² after the nitriding. There was established metallographically and roentgengraphically on the samples an 18–22 mμ thick iron nitride-compound layer. A diffusion zone of 0.55 mm came into existence below the compound layer.

In 24 hours, the cyanate content fell from around 39 weight % to about 37 weight % and the carbonate content increased from around 14 weight % to about 16 weight %. By the addition of 1.2 kg. of melon, the starting values for the cyanate content and the carbonate content are again reestablished without skimming off waste salts.

EXAMPLE 2

In the same bath there were treated sample plates of different materials for 90 minutes at 560° C. while passing 200 l/h of air through the bath and the samples examined. Thereby there resulted the following iron nitride layer thicknesses.

| | |
|---|---|
| 20 MnCr 4 | 12–14 mμ |
| 15 CrNi 6 | 10–12 mμ |
| 14 Ni 6 | 11–14 mμ |
| spheroidal graphite iron | 8–14 mμ |
| gray cast iron | 10–20 mμ |

These layer thicknesses correspond to about the same as a comparably treated CK 15 sample.

EXAMPLE 3

In the following salt baths, in each case operating for 24 hours, the original cyanate and carbonate contents were again established in each case using 1.2 kg. of melon without an accumulation of waste salts. Air was passed through the baths at the rate of 200 l/h.

a. 75 kg KCNO, 20 kg. $Na_2CO_3$, 3 kg. $K_2CO_3$ and 2 kg. NaCN. Cyanate content around 39 weight % as $CNO^-$.

b. 68 kg, KCNO, 10 kg. NaCNO, 8 kg. $K_2CO_3$ and 14 kg. $Na_2CO_3$. Cyanate content around 42 weight % as CNO.

c. 35 kg. KCNO, 35 kg. NaCNO, 10 kg. $K_2CO_3$ and 20 kg. $Na_2CO_3$. Cyanate content around 41 weight % as CNO.

EXAMPLE 4

There were melted and heated to 570° C. in a titanium crucible according to Example 1, 100 kg. of KCNO. There were led through the thin fluid melt 200 liters of air per hour. There were treated in this bath for 90 minutes several plate shaped samples of CK 15 steel and then the samples were quenched in salt water without cyanide being detectable. The samples had an iron nitride-compound layer having a thickness of 8–10 mμ.

In 24 hours the cyanate content fell from around 52 weight % to 50 weight %, the carbonate content increased from 0 weight % to about 2 weight %. By addition of 1.2 kg. of melon the starting values were again established.

EXAMPLE 5

There were melted and heated to 570° C. in a titanium crucible according to Example 1, 58 kg. $K_2CO_3$ and 42 kg. NaCNO. Air was led through the bath at the rate of 20 1/h. Samples of CK 15 steel after 90 minutes showed an iron nitride-compound layer of 6–10 mμ. The cyanate content which had fallen in 24 hours from about 27 weight % to 25 weight % was restored to the original value again by the addition of 1.2 kg. of melon; likewise the carbonate content which had risen from 25 weight % to 27 weight % was restored to its original value.

EXAMPLE 6

There were melted and heated to 570° C. in a titanium crucible according to Example 1, 64 kg. KCNO, 16 kg, $K_2CO_3$, 11 kg. NaCNO, 4 kg. NaCN and 5 kg. NaCl and 200 1h of air led through the salt melt. After 90 minutes treatment of a CK 15 sample plate there was detectable a 10–14 mμ thick iron nitride compound layer. The cyanate content fell from about 40 weight % to about 38 weight % in 24 hours while the carbonate content increased from about 7 weight % to 9 weight %. By the addition of 1.2 kg. melon the original values of cyanate and carbonate were restored.

Besides the work materials mentioned herein, there can also be nitrided, for example, all other steels, alloyed or unalloyed.

EXAMPLE 7

There were melted in a cylindrical titanium crucible (diameter 35 cm., height 70 cm.) 64 kg. of KCNO, 16 kg. of NaCNO, 16 kg. of $K_2CO_3$ and 4 kg. of $Na_2$ $CO_3$ and the melt heated to 570° C. 200 liters of air per hour were led through the melt. In 24 hours the cyanate content fell from 43 weight % to 40 weight % and the carbonate content increased from 10 weight % to 13 weight %. By the addition of 3 kg. of melon, the beginning values of cyanate and carbonate were restored.

Notched fatigue test bars ($\alpha_K = 2$) and disc samples of CK 15 steel were treated for two hours in this bath and then quenched in salt water. Testing the fatigue rotating strength on a Schenk-Rapid fatigue testing machine there resulted an increase from $\delta_{bw} = 12$ kgf/mm² (kilograms force/mm²) to $\delta_{bw} = 42$ kgf/mm². There was established metallographically and by X-ray techniques on the disc specimen an 18–22 mμ thick $\epsilon$-$Fe_xN$-compound layer. A diffusion zone of 0.55 mm came into existence below the compound layer. The total thickness of this diffusion zone can be established with annealed samples (annealing temperature 300° C.) based on the depth of the needle zone.

The process can comprise, consist essentially of, or consist of the steps set forth.

What is claimed is:

1. In a process comprising nitriding iron or steel in a salt bath at nitriding temperature, and regenerating the salt bath in which there has been loss of cyanate during the nitriding, the improvement comprising heating the iron or steel in a salt bath consisting essentially of a member of the group consisting of:

1. potassium cyanate alone;
2. potassium cyanate admixed with at least one compound of the group consisting of sodium cyanate, potassium carbonate, sodium carbonate and an alkali metal chloride; and
3. sodium cyanate admixed with at least one compound of the group consisting of potassium carbonate, sodium carbonate and an alkali metal chloride, said bath containing 25–57 weight % cyanate calculated as cyanate ion, 0–5 weight % cyanide calculated as cyanide ion, 0–30 weight % alkali metal chloride and balance potassium ion, sodium ion and carbonate ion and after the cyanate content of the bath has fallen and the carbonate content increased readjusting the cyanate content and carbonate content by adding triazine polymer of the group consisting of melon, melan and melem to the salt bath without removing waste salts from the bath, the amount of said triazine polymer added being 0.5 to 1.5% for each 1% decrease of cyanate.

2. A process according to claim 1, wherein the triazine polymer is melon.

3. A process according to claim 1, wherein the triazine polymer is melam.

4. A process according to claim 1, wherein the triazine polymer is melem.

5. A process according to claim 1, wherein the salt bath consists essentially of KCNO with 0 to 4% cyanide calculated as cyanide ion.

6. A process according to claim 1, wherein the salt bath consists essentially of KCNO, NaCNO, $Na_2CO_3$ and $K_2CO_3$ with 0 to 4% cyanide calculated as cyanide ion.

7. A process according to claim 1, wherein the salt bath consists essentially of KCNO, $Na_2CO_3$ and $K_2CO_3$ with 0 to 4% cyanide calculated as cyanide ion.

8. A process according to claim 1, wherein the salt bath consists essentially of $K_2CO_3$ and NaCNO with 0 to 4% cyanide calculated as cyanide ion.

9. A process according to claim 1, wherein the salt bath consists essentially of NaCNO, KCNO and $Na_2$ $CO_3$ with 0 to 4% cyanide calculated as cyanide ion.

10. A process according to claim 1, wherein the salt bath consists of KCNO and $K_2CO_3$ NaCNO and NaCl with 0 to 4% cyanide calculated as cyanide ion.

11. A process according to claim 1, wherein the salt bath consists essentially of, at least one of potassium cyanate and sodium cyanate with at least one of potassium carbonate and sodium carbonate.

12. A process according to claim 11, wherein the salt bath consists essentially of KCNO and at least one of $Na_2CO_3$ and $K_2CO_3$.

13. A process according to claim 1, wherein the salt bath contains 33–42% cyanate.

14. A process according to claim 1, wherein the sodium to potassium ratio in the salt bath is from 0 to 1.5:1.

15. A process according to claim 14, wherein th sodium to potassium ratio in the salt bath is from 0 to 0.5:1.

16. A process according to claim 15, wherein the polymer is melon.

17. A process according to claim 13, wherein the polymer is melon.

18. A process according to claim 11, wherein the polymer is melon.

19. In a process for the regeneration of a salt melt bath used for nitriding a metal piece in which there has been loss of cyanate during the nitriding, said salt bath consisting essentially of carbonate and cyanate and in which air is passed through the melt, said bath containing 25–57 weight % cyanate calculated as cyanate ion, 0 to 3% cyanide calculated as cyanide ion and balance potassium ion, sodium ion and carbonate ion, the improvement comprising adding to the bath a triazine polymer selected from the group consisting of melam, melem and melon.

20. A process according to claim 19, wherein the triazine polymer is melon.

21. A process according to claim 20, comprising continuously adding the triazine polymer to said salt melt at a rate to keep the carbonate content of the melt constant.

22. A process according to claim 19, wherein there is added to the bath for each decrease of 1 weight % of cyanate 0.5 to 1.5 weight % of said triazine polymer.

23. A process according to claim 22, wherein said polymer is melon.

24. A process according to claim 22, wherein the cyanide content of the bath is substantially 0.

25. A process according to claim 19, wherein the cyanide content of the bath is substantially 0.

26. A process according to claim 1, wherein the cyanide content of the bath is substantially 0.

27. A salt bath suitable for nitriding a metal piece and generated by a composition consisting essentially of:

a.
1. potassium cyanate alone;
2. potassium cyanate admixed with at least one compound of the group consisting of sodium cyanate, potassium carbonate, sodium carbonate and an alkali metal chloride; and
3. sodium cyanate admixed with at least one compound of the group consisting of potassium carbonate, sodium carbonate and an alkali metal chloride, and b.
1. a triazine polymer selected from the group consisting of melon, melam and melem, said bath containing 25–57 weight % cyanate calculated as cyanate ion, 0.14 30 weight % alkali metal chloride, 0 to 5 weight % cyanide calculated as cyanide ion, and balance potassium ion, sodium ion and carbonate ion, there being added to the bath for each decrease of 1 weight % of cyanate 0.5 to 1.5 weight % of said triazine polymer.

28. A salt bath according to claim 27, containing 0–4% cyanide.

29. A salt bath according to claim 27, which is free of cyanide.

30. A salt bath according to claim 27, wherein the atomic ratio of sodium to potassium is from 0 to 1.5:1.

31. A salt bath according to claim 30, wherein the atomic ratio of sodium to potassium is from 0 to 0.5:1.

32. A salt bath according to claim 27, which is free of alkali metal chloride.

33. A salt bath according to claim 32 where (a) consists of potassium cyanate, sodium cyanate, potassium carbonate and sodium carbonate.

34. A process according to claim 1 wherein the salt bath consists essentially of at least one of potassium cyanate and sodium cyanate.

* * * * *